US011459750B1

(12) United States Patent
Manesh

(10) Patent No.: US 11,459,750 B1
(45) Date of Patent: Oct. 4, 2022

(54) INSULATED CONCRETE BLOCK ASSEMBLY

(71) Applicant: Nick Manesh, Dallas, TX (US)

(72) Inventor: Nick Manesh, Dallas, TX (US)

( * ) Notice: Subject to any disclaimer, the term of this patent is extended or adjusted under 35 U.S.C. 154(b) by 0 days.

(21) Appl. No.: 17/241,246

(22) Filed: Apr. 27, 2021

(51) Int. Cl.

| | |
|---|---|
| ***E04B 2/26*** | (2006.01) |
| ***E04C 5/08*** | (2006.01) |
| ***E04C 1/39*** | (2006.01) |
| ***E04B 2/02*** | (2006.01) |

(52) U.S. Cl.
CPC ..... *E04B 2/26* (2013.01); *E04C 1/39* (2013.01); *E04C 5/08* (2013.01); *E04B 2002/0291* (2013.01)

(58) Field of Classification Search
CPC ..... E04B 2/26; E04B 2002/0291; E04C 1/39; E04C 5/08
See application file for complete search history.

(56) References Cited

U.S. PATENT DOCUMENTS

| | | | | |
|---|---|---|---|---|
| 5,482,550 | A | 1/1996 | Strait | |
| 5,736,594 | A | 4/1998 | Boles | |
| 5,737,896 | A | 4/1998 | Rodgers | |
| 8,013,029 | B2 | 9/2011 | Shin | |
| 8,252,221 | B2 | 8/2012 | Davies | |
| 8,893,447 | B1 * | 11/2014 | Harris | E04C 5/06 52/223.7 |
| 9,206,597 | B2 * | 12/2015 | Marsh | E04B 2/16 |
| 9,993,941 | B2 | 6/2018 | Lee | |
| 2007/0186502 | A1 * | 8/2007 | Marsh | E04B 2/16 52/604 |
| 2009/0193740 | A1 | 8/2009 | Bennett | |
| 2015/0052837 | A1 * | 2/2015 | Gomes | E04C 1/39 52/745.09 |
| 2017/0247879 | A1 * | 8/2017 | Gomes | E04B 2/34 |

FOREIGN PATENT DOCUMENTS

| | | |
|---|---|---|
| WO | 2009061016 | 5/2009 |

* cited by examiner

*Primary Examiner* — Gisele D Ford

(57) ABSTRACT

An insulated concrete block assembly includes a plurality of blocks is provided and each of the blocks is comprised of a mixture of 60.0 percent Portland cement, 30.0 percent expanded polystyrene foam and 10.0 percent lime. The blocks are stackable on each other to define an exterior wall of a building. A fluid insulation is pourable into each of the voids in each of the blocks when the blocks are stacked, and the fluid insulation is comprised of 70.0 percent polystyrene foam. 25.0 percent Portland cement and 5.0 percent lime. A tensioning cable is provided and a base of the tensioning cable is embedded into a foundation upon which the blocks are stacked. The tensioning cable is tensioned to a predetermined tension load when the tensioning cable is routed through the voids of the blocks that are stacked.

9 Claims, 8 Drawing Sheets

INSULATED CONCRETE BLOCK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to concrete block devices and more particularly pertains to a new concrete block device for constructing a building with high wind shear strength and high seismic tolerance. The device includes a plurality of blocks, each constructed of a propriety mixture of Portland cement and polystyrene, and a fluid insulation that is poured into the blocks when the blocks are stacked to from a wall. Additionally, a plurality of tensioning cables are anchored to a foundation and extended through the blocks for anchoring a roof structure to the foundation.

(2) Description of Related Art Including Information Disclosed Under 37 CFR 1.97 and 1.98

The prior art relates to concrete block devices including a variety of concrete mixtures that involve various ratios of concrete and polystyrene. The prior art discloses a concrete form for forming building blocks with voids. The prior art also discloses a composite masonry block that includes protrusions and correlating depressions for stacking the masonry blocks on top of each other.

BRIEF SUMMARY OF THE INVENTION

An embodiment of the disclosure meets the needs presented above by generally comprising a plurality of blocks is provided and each of the blocks is comprised of a mixture of 60.0 percent Portland cement, 30.0 percent expanded polystyrene foam and 10.0 percent lime. The blocks are stackable on each other to define an exterior wall of a building. A fluid insulation is pourable into each of the voids in each of the blocks when the blocks are stacked, and the fluid insulation is comprised of 70.0 percent polystyrene foam. 25.0 percent Portland cement and 5.0 percent lime. A tensioning cable is provided and a base of the tensioning cable is embedded into a foundation upon which the blocks are stacked. The tensioning cable is tensioned to a predetermined tension load when the tensioning cable is routed through the voids of the blocks that are stacked.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
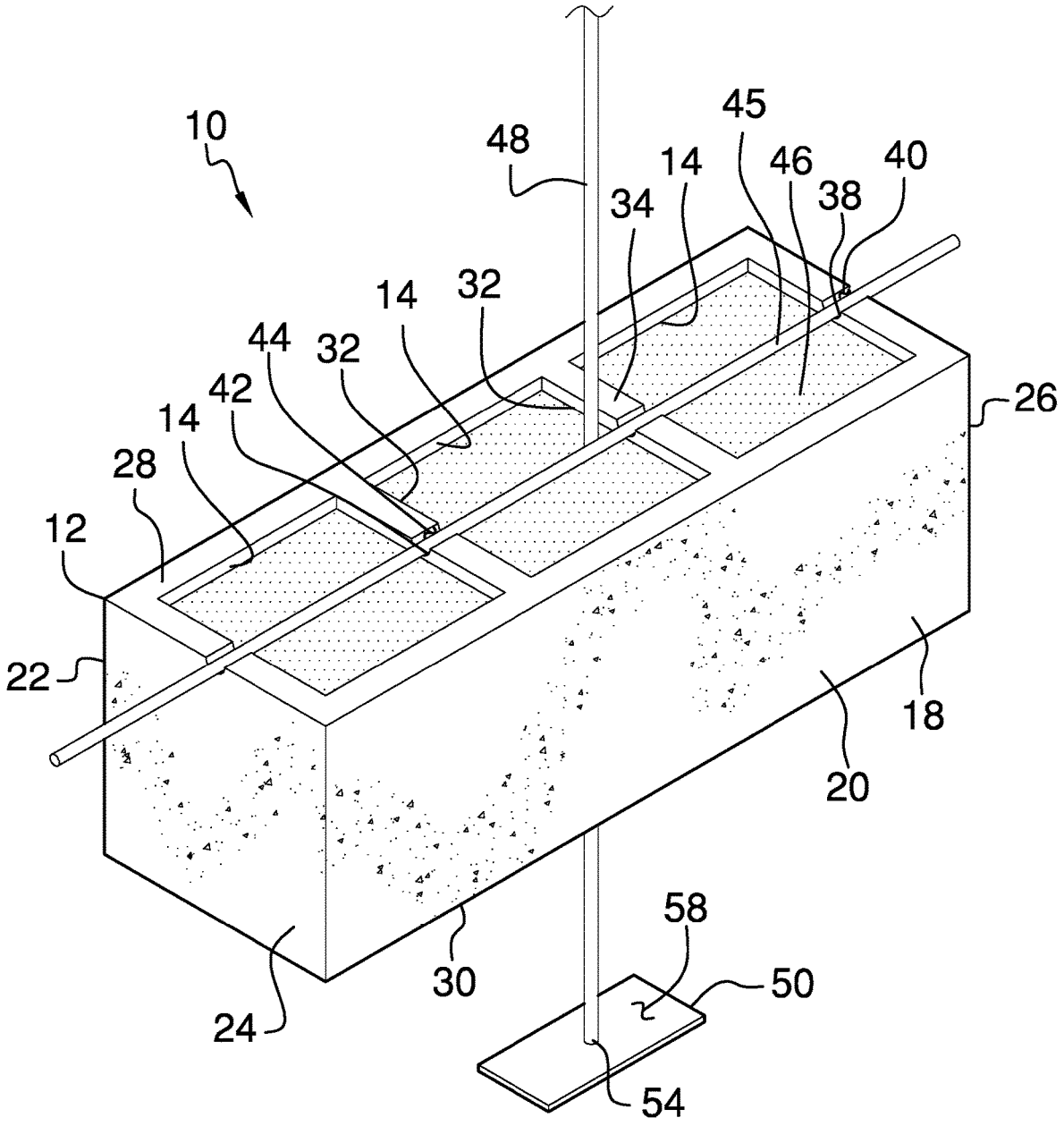
FIG. 1 is a perspective view of an insulated concrete block assembly according to an embodiment of the disclosure.
Figure 2:
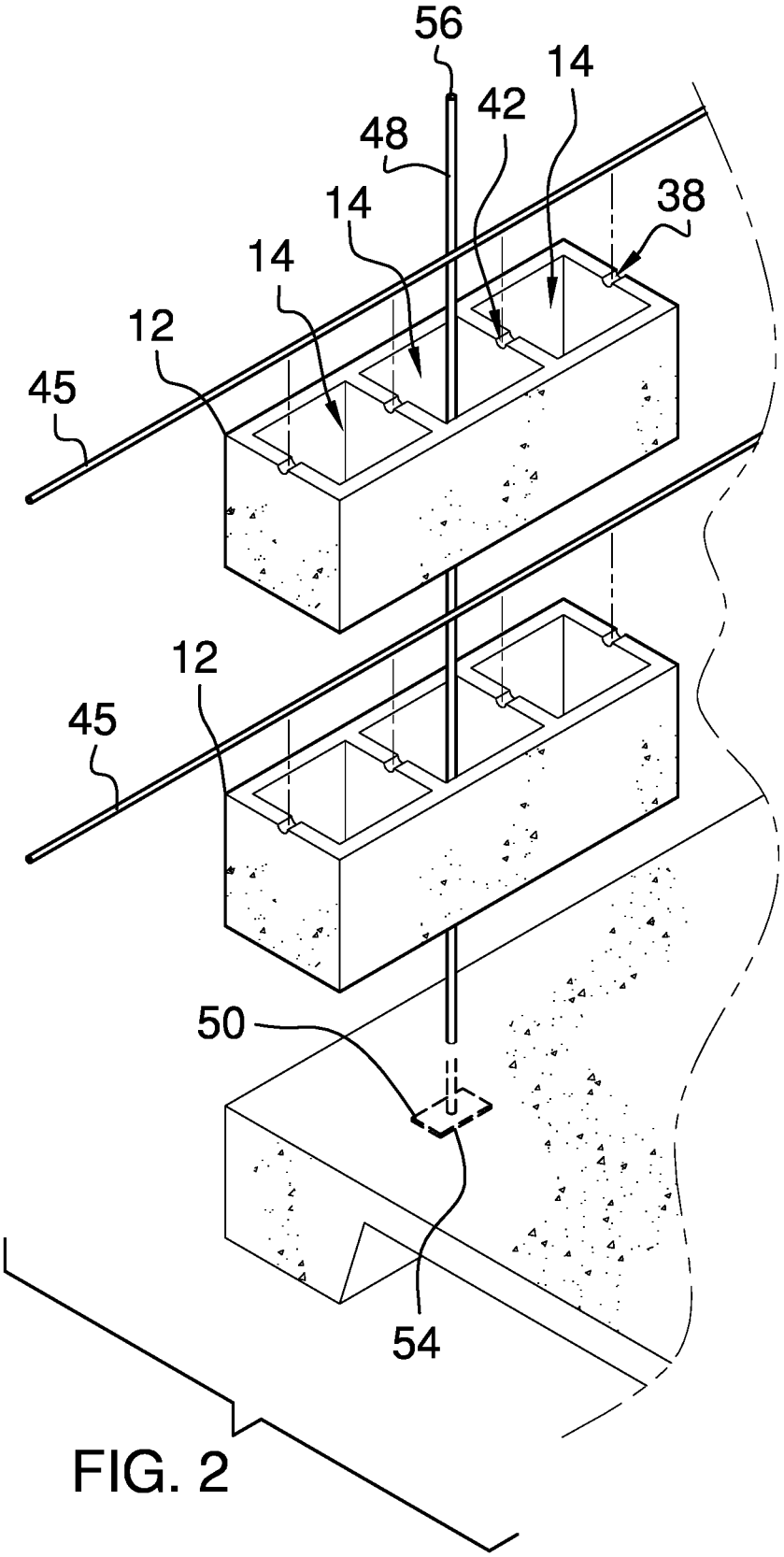
FIG. 2 is an exploded in-use view of an embodiment of the disclosure.
Figure 3:
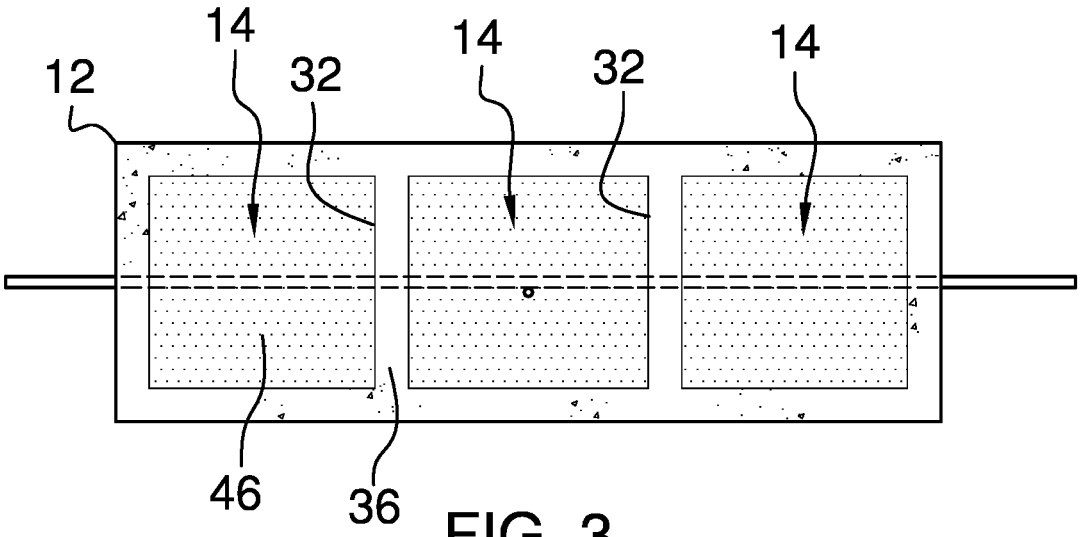
FIG. 3 is a bottom view of an embodiment of the disclosure.
Figure 4:
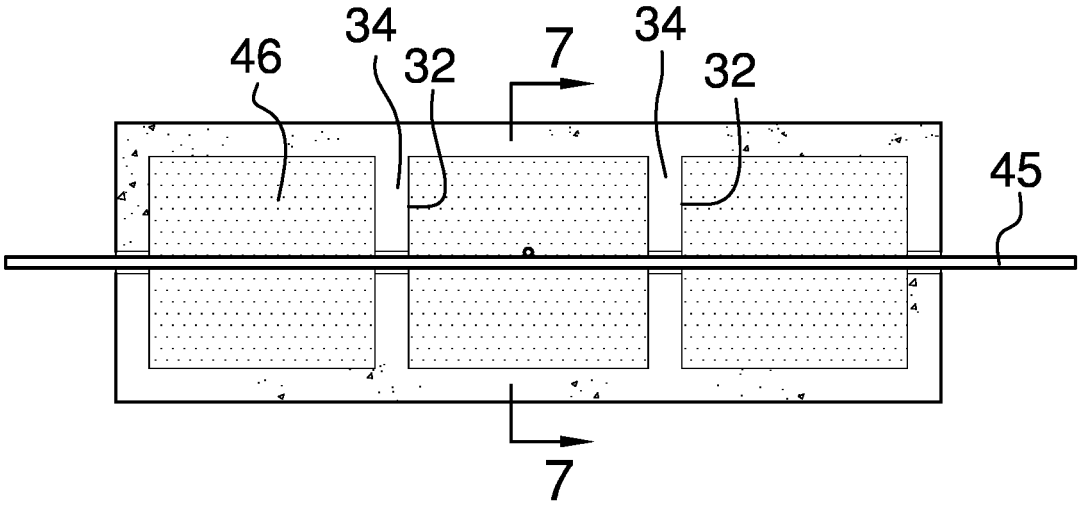
FIG. 4 is a top view of an embodiment of the disclosure.
Figure 5:
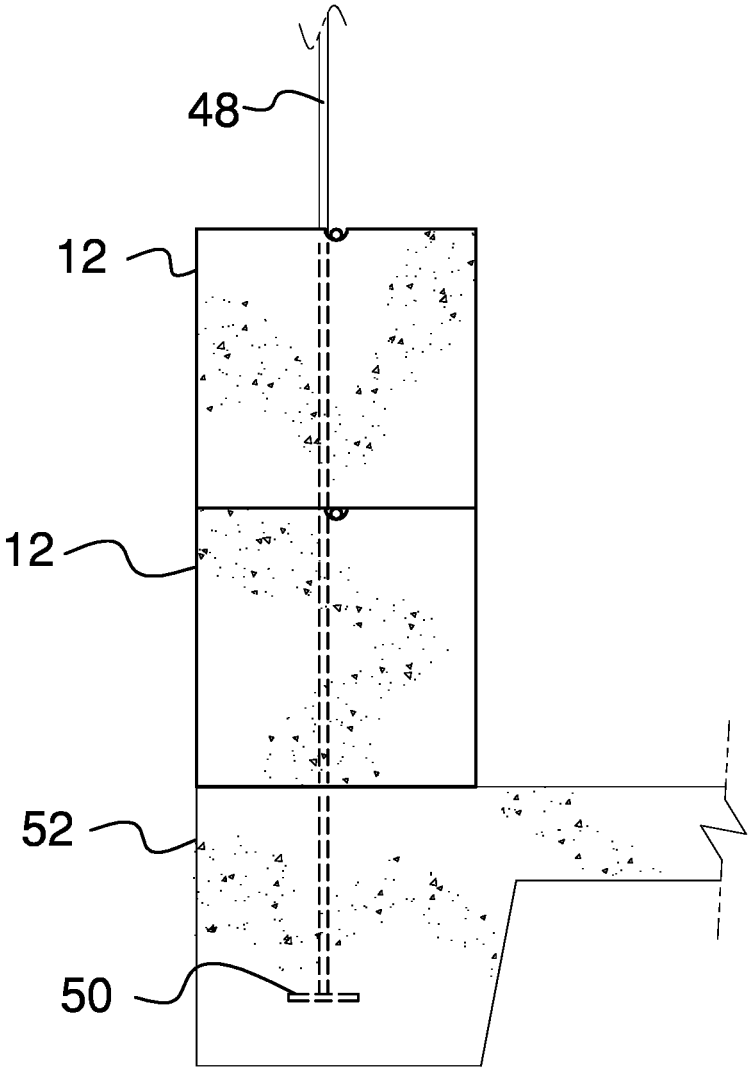
FIG. 5 is a side phantom in-use view of an embodiment of the disclosure.
Figure 6:
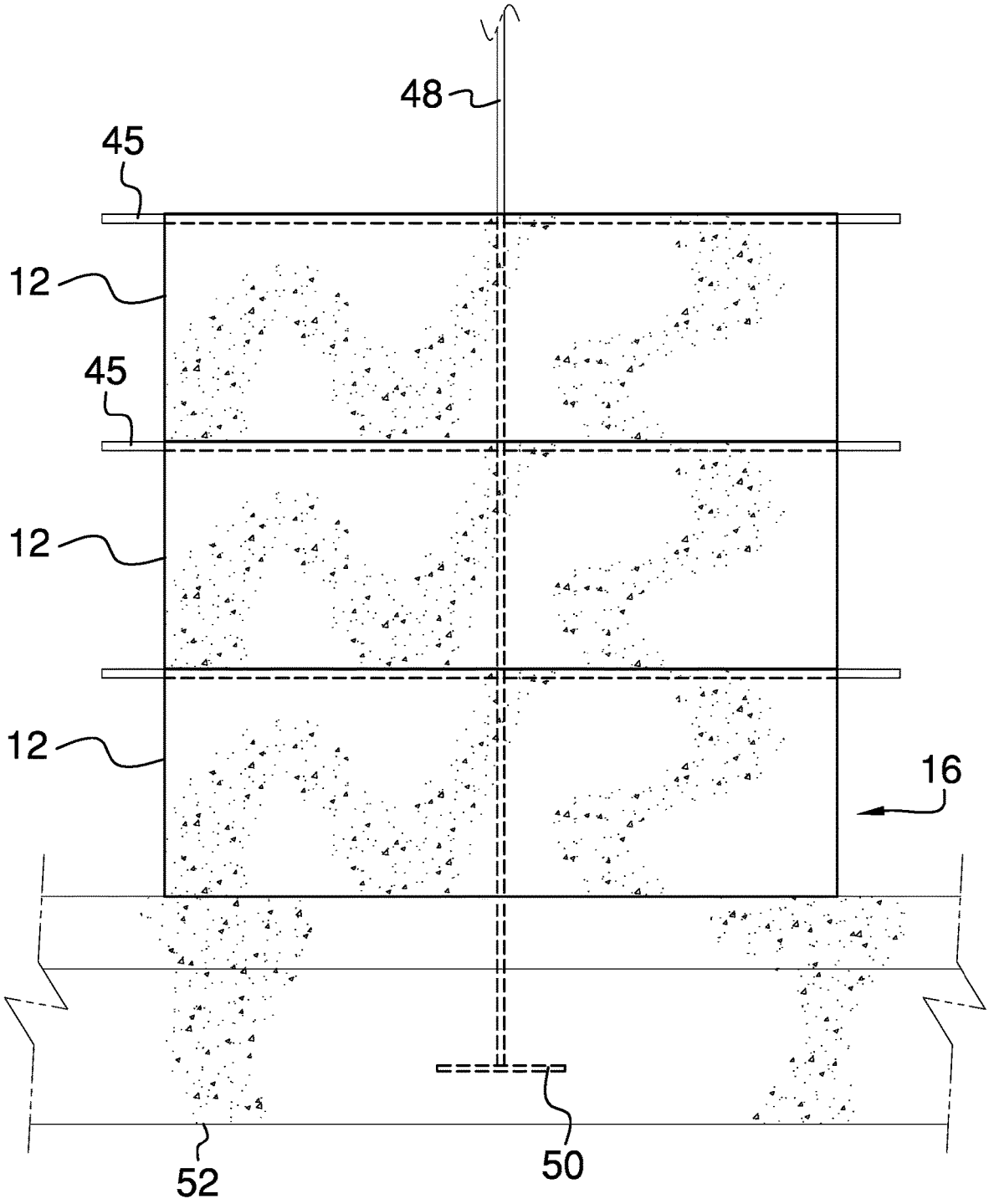
FIG. 6 is a front phantom in-use view of an embodiment of the disclosure.
Figure 7:
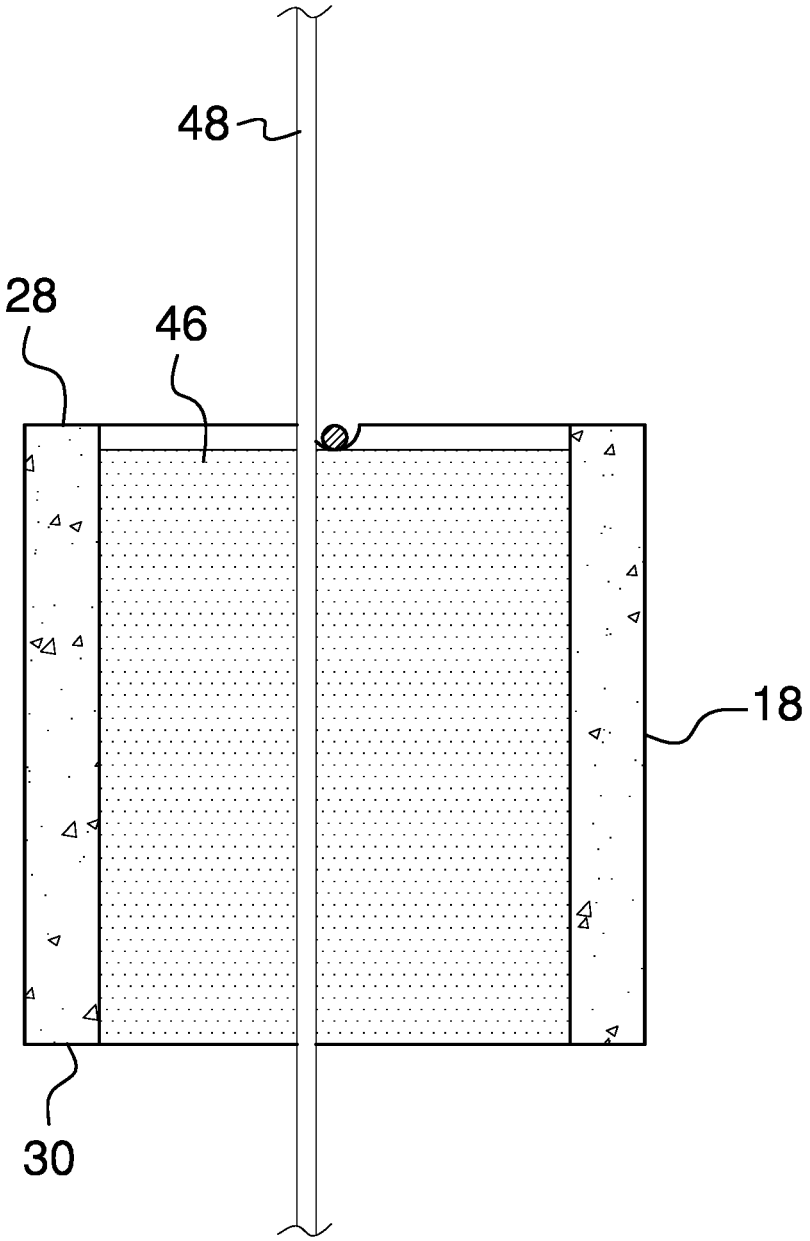
FIG. 7 is a cross sectional view taken along line 7-7 of FIG. 4 of an embodiment of the disclosure.

With reference now to the drawings, and in particular to FIGS. 1 through 9 thereof, a new concrete block device embodying the principles and concepts of an embodiment of the disclosure and generally designated by the reference numeral 10 will be described.

As best illustrated in FIGS. 1 through 9, the insulated concrete block assembly 10 generally comprises a plurality of blocks 12 that is each comprised of a mixture of 60.0 percent Portland cement, 30.0 percent expanded polystyrene foam and 10.0 percent lime. Additionally, the expanded polystyrene foam is comprised of at least 95.0 percent recycled polystyrene. This particular mixture of Portland cement, expanded polystyrene and lime facilitates a high degree of strength with a low degree of weight. Additionally, each of the blocks 12 is formed to define a plurality of voids 14 in the blocks 12. The blocks 12 are stackable on each other to define an exterior wall 16 of a building, such as a house, an office building or other type of occupancy. Additionally, the building may be located in a location that regularly experiences strong winds or a location that regularly experiences seismic activity. The Portland cement may be mixed to yield a minimum of 3000.0 psi compressive strength.

Each of the blocks 12 has an outer wall 18, and the outer wall 18 has a front side 20, a back side 22, a first lateral side 24 and a second lateral side 26, and each of the blocks 12 is elongated between the first lateral side 24 and the second lateral side 26. The outer wall 18 has a top edge 28 and a bottom edge 30, and each of the blocks 12 has a plurality of dividing walls 32 each extending between the front side 20 and the back side 22. The dividing walls 32 are spaced apart from each other and are distributed between the first lateral side 24 and the second lateral side 26 to define the plurality of voids 14.

Each of the dividing walls 32 has an upper edge 34 and a lower edge 36. The upper edge 34 of each of the dividing walls 32 is aligned with the top edge 28 of the outer wall 18, and the lower edge 36 of each of the dividing walls 32 is aligned with the bottom edge 30 of the outer wall 18. The top edge 28 associated with each of the first lateral side 24 and the second lateral side 26 has a channel 38 extending downwardly in the outer wall 18. The channel 38 is oriented to extend along a line which extends through the first lateral side 24 and the second lateral side 26, and the channel 38 is centrally positioned between the front side 20 and the back side 22. Additionally, the channel 38 has a bounding surface 40 and the bounding surface 40 is concavely arcuate with respect to the top edge 28.

The upper edge 34 of each of the dividing walls 32 has a channel 42 extending downwardly in the upper edge 34, and the channel 42 in the upper edge 34 is oriented to extend along the line that extends through the first lateral side 24 and the second lateral side 26. The channel 42 in the upper edge 34 has a bounding surface 44, and the bounding surface 44 of the channel 42 in the upper edge 34 is concavely arcuate with respect to the upper edge 34. The channel 42 in the upper edge 34 of each of the dividing walls 32 is aligned with each of the channels 38 in the top edge 28. In this way the channels 42 in each of the dividing walls 32 and the channels 38 in the outer wall 18 can accommodate rebar 45 when the blocks 12 are stacked. The rebar 45 may be #3 rebar, #4 rebar, #5 rebar or any rebar that is required per building code for the location in which the building is being constructed. The blocks 12 are stackable such that the bottom edge 30 of a respective block 12 rests on the top edge 28 of a respective block 12. The blocks 12 may be stacked in the convention of masonry construction practices, including the use of grout and other approved methods for constructing block walls.

A fluid insulation 46 is provided and the fluid insulation 46 is pourable into each of the voids 14 in each of the blocks 12 when the blocks 12 are stacked. In this way the fluid insulation 46 increases the thermal mass of the blocks 12 thereby enhancing the thermal performance of the building. Additionally, the fluid insulation 46 reduces the amount of sound that can pass through the blocks 12, thereby insulating an interior of the building from exterior noises. The fluid insulation 46 is comprised of 70.0 percent polystyrene foam, 25.0 percent Portland cement and 5.0 percent lime. Additionally, the polystyrene foam in the fluid insulation 46 is at least 95.0 percent recycled polystyrene.

A plurality of tensioning cables 48 is provided and each of the tensioning cables 48 includes a base 50 that is embedded into a foundation 52 upon which the blocks 12 are stacked to anchor the tensioning cables 48 to the foundation 52. The foundation 52 may be a monolithic concrete foundation and each of the tensioning cables 48 may be located prior to pouring the monolithic concrete foundation. In this way each of the tensioning cables 48 can be integrated into the foundation 52. The tensioning cables 48 are extended upwardly through the voids 14 of the blocks 12 that are stacked on each other. In this way the tensioning cables 48 can be attached to a roof structure thereby facilitating the roof structure to be anchored to the foundation 52. Thus, the tensioning cables 48 enhance the ability of the building to withstand excessive wind shear forces and seismic forces that would damage conventional wood framed buildings.

Each of the tensioning cables 48 is tensioned to a predetermined tension load when the tensioning cables 48 are routed through the voids 14 of the blocks 12 that are stacked. In this way the tensioning cables 48 enhance the structural rigidity of the exterior wall 16 defined by the stacked blocks 12. The tensioning cables 48 may be tightened to a load ranging between approximately 15.0 kip and 20.0 kip. Each of the tensioning cables 48 has a first end 54 and a second end 56, and the base 50 has an upper surface 58. The first end 54 of each of the tensioning cables 48 is coupled to the upper surface 58 of the respective base 50. Each of the tensioning cables 48 extends upwardly out of the exterior wall 16 defined by the stacked blocks 12 having the second end 56 of each of the tensioning cables 48 being exposed for attaching to the roof structure. The base 50 may be a steel plate that has a width of approximately 4.0 inches and a length of approximately 8.0 inches. Each of the tensioning cables 48 may have a diameter ranging between approximately 0.025 inches and 1.0 inch, depending on structural codes pertaining to seismic activity and wind shear.

Figure 8:
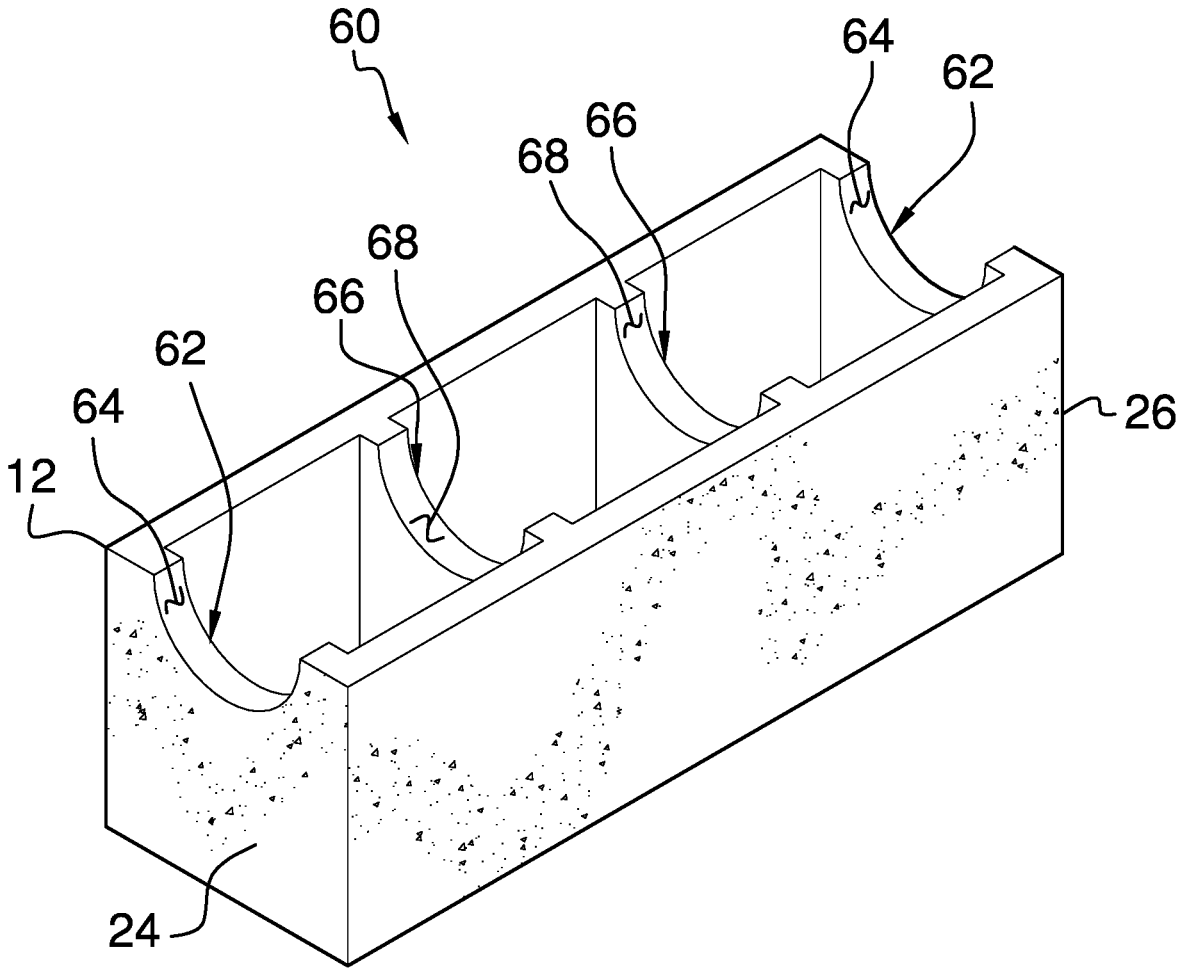
FIG. 8 is a perspective view of an alternative embodiment of the disclosure.
Figure 9:
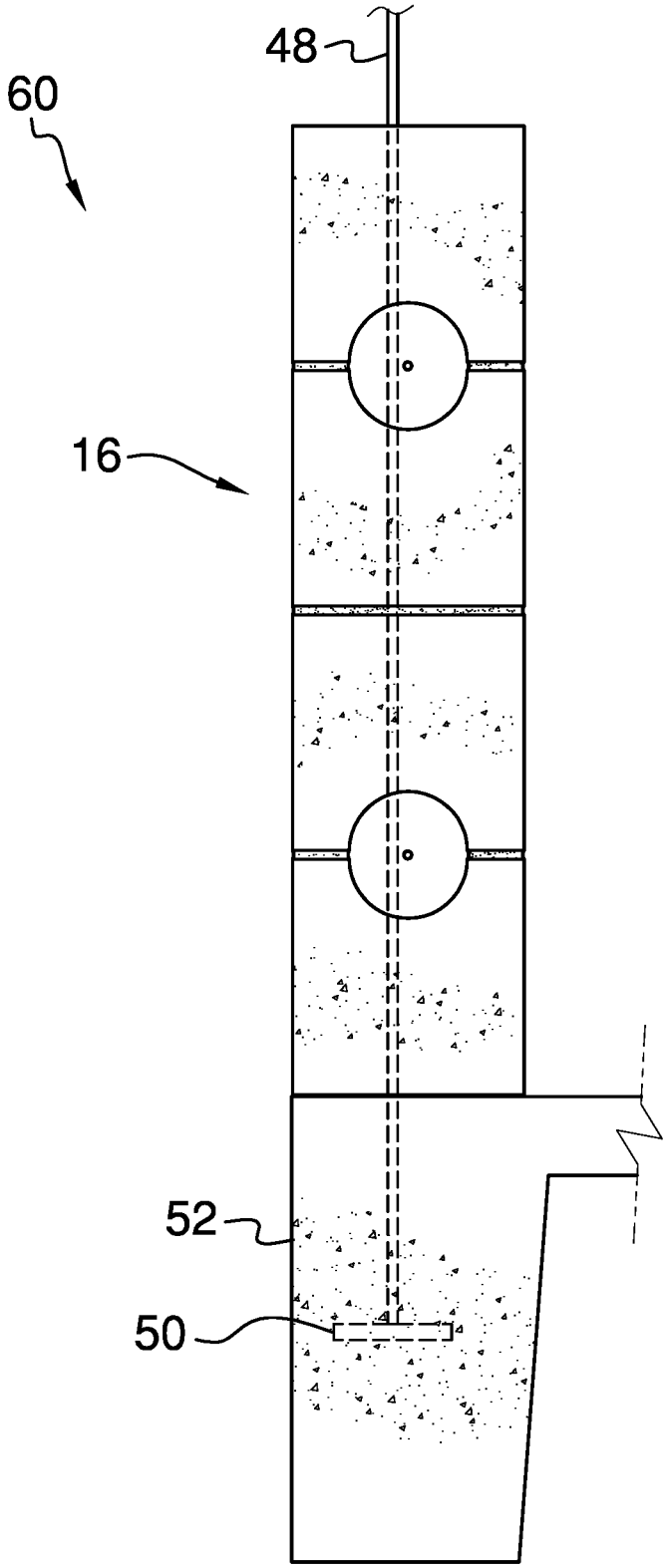
FIG. 9 is a perspective in-use view of an alternative embodiment of the disclosure.

In an alternative embodiment 60 as is most clearly shown in FIGS. 8 and 9, the top edge 28 associated with each of the first lateral side 24 and the second lateral side 26 has a scallop 62 extending downwardly in the top edge 28. The scallop 62 extends substantially between the front side 20 and the back side 22. The scallop 62 has a bounding surface 64, and the bounding surface 64 of the scallop 62 is concavely arcuate with respect to the top edge 28. The upper edge 34 of each of the dividing walls 32 has a scallop 66 extending downwardly in the upper edge 34, and the scallop 66 in the upper edge 34 extends substantially between the front side 20 and the back side 22. Additionally, the scallop 66 in the upper edge 34 has a bounding surface 68, and the bounding surface 68 of the scallop 66 in the upper edge 34 is concavely arcuate with respect to the upper edge 34. As is most clearly shown in FIG. 9, the blocks 12 may be stacked such that the scallops 62, 66 in adjacent blocks 12 are aligned with each other to define a hole 68 through which the rebar 45 can be extended.

In use, each of the tensioning cables 48 is integrated into the foundation 52 according to best practices and according to engineering requirements. The blocks 12 are stacked to build the exterior wall 16 and rebar 45 is positioned in the blocks 12 as is required by building code. The voids 14 in the blocks 12 are filled with the fluid insulation 46 as the blocks 12 are being stacked until the entire height of the exterior wall 16 is filled with the fluid insulation 46. Additionally, the roof structure of the building is anchored to each of the tensioning cables 48. In this way the building can be constructed in manner the produces exception wind shear resistance and exceptional seismic tolerance. Moreover, the blocks 12 and fluid insulation 46 inhibit the formation of mold, facilitate a high thermal mass for exceptional thermal efficiency and facilitate a high degree of sound insulation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An insulated concrete block assembly for constructing a building with high resistance to wind shear and seismic forces, said assembly comprising:

a plurality of blocks, each of said blocks being comprised of a mixture of 60.0 percent Portland cement, 30.0 percent expanded polystyrene foam and 10.0 percent lime, each of said blocks being formed to define a plurality of voids in said blocks, said blocks being stackable on each other to define an exterior wall of a building;

a fluid insulation being pourable into each of said voids in each of said blocks when said blocks are stacked wherein said fluid insulation is configured to increase the thermal mass of said blocks, said fluid insulation being comprised of 70.0 percent polystyrene foam, 25.0 percent Portland cement and 5.0 percent lime; and a tensioning cable having a base being embedded into a foundation upon which said blocks are stacked wherein said tensioning cable is configured to be anchored to the foundation, said tensioning cable being extended upwardly through said voids of said blocks that are stacked on each other wherein said cable is configured to be attached to a roof structure, said tensioning cable being tensioned to a pre-determined tension load when said tensioning cable is routed through said voids of said blocks that are stacked wherein said tensioning cable is configured to enhance structural rigidity of said exterior wall defined by said stacked blocks.

2. The assembly according to claim 1, wherein:

each of said blocks has an outer wall, said outer wall having a front side, a back side, a first lateral side and a second lateral side, each of said blocks being elongated between said first lateral side and said second lateral side, said outer wall having a top edge and a bottom edge;

each of said blocks has a plurality of dividing walls each extending between said front side and said back side, said dividing walls being spaced apart from each other and being distributed between said first lateral side and said second lateral side to define said plurality of voids, each of said dividing walls having an upper edge and a lower edge, said upper edge of each of said dividing walls being aligned with said top edge of said outer wall, said lower edge of each of said dividing walls being aligned with said bottom edge of said outer wall;

said top edge associated with each of said first lateral side and said second lateral side has a channel extending downwardly in said outer wall, said channel being oriented to extend along a line extending through said first lateral side and said second lateral side, said channel being centrally positioned between said front side and said back side, said channel having a bounding surface, said bounding surface being concavely arcuate with respect to said top edge; and said upper edge of each of said dividing walls has a channel extending downwardly in said upper edge, said channel in said upper edge being oriented to extend along said line extending through said first lateral side and said second lateral side, said channel in said upper edge having a bounding surface, said bounding surface of said channel in said upper edge being concavely arcuate with respect to said upper edge.

3. The assembly according to claim 2, Wherein said channel in said upper edge of each of said dividing walls is aligned with each of said channels in said top edge wherein said channels in each of said dividing walls and said channels in said outer wall are configured to accommodate rebar when said blocks are stacked, said blocks being stackable such that said bottom edge of a respective block rests on said top edge of a respective block.

4. The assembly according to claim 1, wherein said tensioning cable has a first end and a second end, said base having an upper surface, said first end of said tensioning cable being coupled to said upper surface, said base, said tensioning cable extending upwardly out, of said exterior wall defined by said stacked blocks having said second end of said tensioning cable being exposed wherein said second end is configured to be attached to the roof structure.

5. An insulated concrete block assembly for constructing a building with high resistance to wind shear and seismic forces, said assembly comprising:

a plurality of blocks, each of said blocks being formed to define a plurality of voids in said blocks, said blocks being stackable on each other to define an exterior wall of a building, each of said blocks having an outer wall, said outer wall having a front side, a back side, a first lateral side and a second lateral side, each of said blocks being elongated between said first lateral side and said second lateral side, said outer wall having a top edge and a bottom edge, each of said blocks having a plurality of dividing walls each extending between said front side and said back side, said dividing walls being spaced apart from each other and being distributed between said first lateral side and said second lateral side to define said plurality of voids, each of said dividing walls having an upper edge and a lower edge, said upper edge of each of said dividing walls being aligned with said top edge of said outer wall, said lower edge of each of said dividing walls being aligned with said bottom edge of said outer wall, said top edge associated with each of said first lateral side and said second lateral side having a channel extending downwardly in said outer wall, said channel being oriented to extend along a line extending through said first lateral side and said second lateral side, said channel being centrally positioned between said front side and said back side, said channel having a bounding surface, said bounding surface being concavely arcuate with respect to said top edge, said upper edge of each of said dividing walls having a channel extending downwardly in said upper edge, said channel in said upper edge being oriented to extend along said line extending through said first lateral side and said second lateral side, said channel in said upper edge having a bounding surface, said bounding surface of said channel in said upper edge being concavely arcuate with respect to said upper edge, said channel in said upper edge of each of said dividing walls being aligned with each of said channels in said top edge wherein said channels in each of said dividing walls and said channels in said outer wall are configured to accommodate rebar when said blocks are stacked, said blocks being stackable such that said bottom edge of a respective block rests on said top edge of a respective block;

a fluid insulation being pourable into each of said voids in each of said blocks when said blocks are stacked wherein said fluid insulation is configured to increase the thermal mass of said blocks;

a tensioning cable having a base being embedded into a foundation upon which said blocks are stacked wherein said tensioning cable is configured to be anchored to the foundation, said tensioning cable being extended upwardly through said voids of said blocks that are stacked on each other wherein said cable is configured to be attached to a roof structure, said tensioning cable being tensioned to a pre-determined tension load when said tensioning cable is routed through said voids of said blocks that are stacked wherein said tensioning cable is configured to enhance structural rigidity of said exterior wall defined by said stacked blocks, said tensioning cable having a first end and a second end, said base having an upper surface, said first end of said tensioning cable being coupled to said upper surface, said base, said tensioning cable extending upwardly out of said exterior wall defined by said stacked blocks having said second end of said tensioning cable being exposed wherein said second end is configured to be attached to the roof structure; and wherein each of said blocks is comprised of a mixture of 60.0 percent Portland cement, 30.0 percent expanded polystyrene foam and 10.0 percent lime.

6. An insulated concrete block assembly for constructing a building with high resistance to wind shear and seismic forces, said assembly comprising:

a plurality of blocks, each of said blocks being formed to define a plurality of voids in said blocks, said blocks being stackable on each other to define an exterior wall of a building, each of said blocks having an outer wall, said outer wall having a front side, a back side, a first lateral side and a second lateral side, each of said blocks being elongated between said first lateral side and said second lateral side, said outer wall having a top edge and a bottom edge, each of said blocks having a plurality of dividing walls each extending between said front side and said back side, said dividing walls being spaced apart from each other and being distributed between said first lateral side and said second lateral side to define said plurality of voids, each of said dividing walls having an upper edge and a lower edge, said upper edge of each of said dividing walls being aligned with said top edge of said outer wall, said lower edge of each of said dividing walls being aligned with said bottom edge of said outer wall, said top edge associated with each of said first lateral side and said second lateral side having a channel extending downwardly in said outer wall, said channel being oriented to extend along a line extending through said first lateral side and said second lateral side, said channel being centrally positioned between said front side and said back side, said channel having a bounding surface, said bounding surface being concavely arcuate with respect to said top edge, said upper edge of each of said dividing walls having a channel extending downwardly in said upper edge, said channel in said upper edge being oriented to extend along said line extending through said first lateral side and said second lateral side, said channel in said upper edge having a bounding surface, said bounding surface of said channel in said upper edge being concavely arcuate with respect to said upper edge, said channel in said upper edge of each of said dividing walls being aligned with each of said channels in said top edge wherein said channels in each of said dividing walls and said channels in said outer wall are configured to accommodate rebar when said blocks are stacked, said blocks being stackable such that said bottom edge of a respective block rests on said top edge of a respective block;

a fluid insulation being pourable into each of said voids in each of said blocks when said blocks are stacked wherein said fluid insulation is configured to increase the thermal mass of said blocks;

a tensioning cable having a base being embedded into a foundation upon which said blocks are stacked wherein said tensioning cable is configured to be anchored to the foundation, said tensioning cable being extended upwardly through said voids of said blocks that are stacked on each other wherein said cable is configured to be attached to a roof structure, said tensioning cable being tensioned to a pre-determined tension load when said tensioning cable is routed through said voids of said blocks that are stacked wherein said tensioning cable is configured to enhance structural rigidity of said exterior wall defined by said stacked blocks, said tensioning cable having a first end and a second end, said base having an upper surface, said first end of said tensioning cable being coupled to said upper surface, said base, said tensioning cable extending upwardly out of said exterior wall defined by said stacked blocks having said second end of said tensioning cable being exposed wherein said second end is configured to be attached to the roof structure; and wherein said fluid insulation is comprised of 70.0 percent polystyrene foam, 25.0 percent Portland cement and 5.0 percent lime.

7. An insulated concrete block assembly for constructing a building with high resistance to wind shear and seismic forces, said assembly comprising:

a plurality of blocks, each of said blocks being comprised of a mixture of 60.0 percent Portland cement, 30.0 percent expanded polystyrene foam and 10.0 percent lime, each of said blocks being formed to define a plurality of voids in said blocks, said blocks being stackable on each other to define an exterior wall of a building, each of said blocks having an outer wall, said outer wall having a front side, a back side, a first lateral side and a second lateral side, each of said blocks being elongated between said first lateral side and said second lateral side, said outer wall having a top edge and a bottom edge, each of said blocks having a plurality of dividing walls each extending between said front side and said back side, said dividing walls being spaced apart from each other and being distributed between said first lateral side and said second lateral side to define said plurality of voids, each of said dividing walls having an upper edge and a lower edge, said upper edge of each of said dividing walls being aligned with said top edge of said outer wall, said lower edge of each of said dividing walls being aligned with said bottom edge of said outer wall, said top edge associated with each of said first lateral side and said second lateral side having a channel extending downwardly in said outer wall, said channel being oriented to extend along a line extending through said first lateral side and said second lateral side, said channel being centrally positioned between said front side and said back side, said channel having a bounding surface, said bounding surface being concavely arcuate with respect to said top edge, said upper edge of each of said dividing walls having a channel extending downwardly in said upper edge, said channel in said upper edge being oriented to extend along said line extending through said first lateral side and said second lateral side, said channel in said upper edge having a bounding surface, said bounding surface of said channel in said upper edge being concavely arcuate with respect to said upper edge, said channel in said upper edge of each of said dividing walls being aligned with each of said channels in said top edge wherein said channels in each of said dividing walls and said channels in said outer wall are configured to accommodate rebar when said blocks are stacked, said blocks being stackable such that said bottom edge of a respective block rests on said top edge of a respective block;

a fluid insulation being pourable into each of said voids in each of said blocks when said blocks are stacked wherein said fluid insulation is configured to increase the thermal mass of said blocks, said fluid insulation being comprised of 70.0 percent polystyrene foam, 25.0 percent Portland cement and 5.0 percent lime; and a tensioning cable having a base being embedded into a foundation upon which said blocks are stacked wherein said tensioning cable is configured to be anchored to the foundation, said tensioning cable being extended upwardly through said voids of said blocks that are stacked on each other wherein said cable is configured to be attached to a roof structure, said tensioning cable being tensioned to a pre-determined tension load when said tensioning cable is routed through said voids of said blocks that are stacked wherein said tensioning cable is configured to enhance structural rigidity of said exterior wall defined by said stacked blocks, said tensioning cable having a first end and a second end, said base having an upper surface, said first end of said tensioning cable being coupled to said upper surface, said base, said tensioning cable extending upwardly out of said exterior wall defined by said stacked blocks having said second end of said tensioning cable being exposed wherein said second end is configured to be attached to the roof structure.

8. The assembly according to claim 7, wherein said top edge associated with each of said first lateral side and said second lateral side has a scallop extending downwardly in said top edge, said scallop extending substantially between said front side and said back side, said scallop having a bounding surface, said bounding surface of said scallop being concavely arcuate with respect to said top edge.

9. The assembly according to claim 7, Wherein said upper edge of each of said dividing walls has a scallop extending downwardly in said upper edge, said scallop in said upper edge extending substantially between said front side and said back side, said scallop in said upper edge having a bounding surface, said bounding surface of said scallop in said upper edge being concavely arcuate with respect to said upper edge.

* * * * *